US005118221A

United States Patent [19]

Copple

[11] Patent Number: 5,118,221

[45] Date of Patent: Jun. 2, 1992

[54] DEEP WATER PLATFORM WITH BUOYANT FLEXIBLE PILES

[76] Inventor: Robert W. Copple, 5 Glen Dr., Mill Valley, Calif. 94941

[21] Appl. No.: 676,850

[22] Filed: Mar. 28, 1991

[51] Int. Cl.[5] ..... E02B 17/00; E21B 7/12

[52] U.S. Cl. ..... 405/224.2; 405/224; 166/367

[58] Field of Search ..... 405/195, 224, DIG. 8, 405/DIG. 11, 195.1, 223.1, 224.2; 166/350, 359, 367; 175/7; 114/265; 138/89

[56] References Cited

U.S. PATENT DOCUMENTS

| | | | |
|---|---|---|---|
| 3,031,997 | 5/1962 | Nesbitt . | |
| 3,154,039 | 10/1964 | Knapp . | |
| 3,395,755 | 8/1968 | Manning | 166/359 X |
| 3,643,446 | 2/1972 | Mott . | |
| 3,710,580 | 1/1973 | Mott . | |
| 3,720,066 | 3/1973 | Vilain . | |
| 3,922,868 | 12/1975 | McDonald . | |
| 4,040,264 | 8/1977 | Neilon | 405/224.2 |
| 4,060,995 | 12/1977 | Lacroix et al. . | |
| 4,087,984 | 5/1978 | Mo | 405/224 X |
| 4,142,819 | 3/1979 | Challine et al. | 405/196 |
| 4,373,835 | 2/1983 | Haney | 405/195 |
| 4,468,157 | 8/1984 | Horton | 405/224 |
| 4,630,970 | 12/1986 | Gunderson et al. | 405/224 |
| 4,648,747 | 3/1987 | Watkins | 405/224.2 |
| 4,797,033 | 1/1989 | Pollack | 405/224 X |
| 4,813,815 | 3/1989 | McGehee | 405/224 X |
| 4,821,804 | 4/1989 | Pierce | 166/367 |
| 4,923,337 | 5/1990 | Huard | 405/223.1 X |

OTHER PUBLICATIONS

"Exploring the Ocean's Frontiers", Time Magazine, Dec. 17, 1990, p. 98.

Engineering News Record, Aug. 27, 1987, "The Newcomer Tackles the Moose".

Graff, W. J. "Introduction to Offshore Structures", Gulf Publishing Co., 1981.

*Primary Examiner*—Randolph A. Reese

*Assistant Examiner*—John A. Ricci

*Attorney, Agent, or Firm*—McCubbrey, Bartels, Meyer & Ward

[57] ABSTRACT

A deep water platform, suitable for use as a hydrocarbon exploration or production facility in very deep offshore waters, and a method of constructing the same are shown. The platform is positioned on top of a plurality of flexible, buoyant piles made of large diameter, high strength steel tubing. A watertight bulkhead is located within the pile and the portion of the pile below is filled with seawater, while the portion above the bulkhead is substantially empty and in communication with the atmosphere. The bulkhead is positioned to cause the pile to have a predetermined net buoyancy so that the portion below the bulkhead, which is anchored to the seabed, is in tension.

23 Claims, 6 Drawing Sheets part A part A part B part B

DEEP WATER PLATFORM WITH BUOYANT FLEXIBLE PILES

FIELD OF THE INVENTION

The present invention pertains to support structures for deep water platforms, especially those of the type which are used for crude oil exploration and production.

BACKGROUND OF THE INVENTION

There exists an ever increasing demand for oil and gas production from offshore deep water sites. Traditional designs and construction techniques for offshore platforms, most of which have heretofore been constructed in relatively shallow waters, are not readily adaptable for use at very deep locations, for example sites where the water depth exceeds 1000 feet. While several deep water platform designs have been proposed, known designs are either very complicated, expensive, and/or difficult to construct.

Environmental forces, primarily winds, waves and currents can, at times, be very severe at an offshore location, particularly a deep water location which is unlikely to be near any sheltering land mass. Thus, any design for an offshore platform must be able to tolerate the full range of conditions likely to be encountered at the site.

Construction techniques useful at deep water sites are limited. Difficulty arises in bringing long prefabricated structures to a site, providing anchors at a desired seabed location, and anchoring the structures at great depth.

Therefore, an object of the present invention is to provide an offshore platform which is suitable for use at great depths.

Another object of the present invention is to provide an offshore deep water platform which is simple in design, and which is relatively easy and inexpensive to construct.

SUMMARY OF THE INVENTION

The present invention makes use of flexible buoyant piles, rigidly anchored to the seabed, to support an offshore platform or other facility. The piles comprise large diameter tubes, partially filled with seawater in a lower portion and substantially empty in a upper portion, to provide a predetermined buoyancy. Stiff trusses or girders rigidly connecting the piles at or near their upper ends helps prevent lateral and rotational movement of the structure in severe environmental conditions.

The piles of the present invention utilize the buoyancy of large diameter pipes which may be made of high strength steel. Although the diameter of the pipes is relatively large, the diameter is very small in comparison to the length of pipe needed to extend from the water surface to the seabed at a deep water site. Thus, while such a pipe will be comparatively stiff in short lengths, it will be quite flexible over the lengths of interest in deep water applications. The overall amount of flexibility is a function of the length of the pipe, the pipe diameter, the thickness of the walls of the pipe, and the material from which the pipe is fabricated. The diameter of the piles contemplated by this invention is large enough to accommodate the conduits, risers, and other equipment typically associated with offshore oil platforms. This allows many of the functions to be performed at the offshore site, e.g., drilling and production, to be conducted from within the pile. Moreover, the piles may be of sufficient diameter to allow human access throughout the empty portion thereof.

A pile constructed in accordance with the present invention is made buoyant by at least partially emptying its interior volume, so that a large volume of water is displaced. A watertight bulkhead is located within the pile, and the portion of the pile below the bulkhead filled with seawater to provide a predetermined amount of overall buoyancy to the pile. The optimal buoyancy will depend on a variety of factors which are discussed below. The pipe is rigidly anchored to the seabed, preferably by being driven into the subsurface using a pile driver. Additional anchoring may be provided, for example, by driving smaller diameter pipes, located within the hollow pile, further into the seabed and then grouting them to sleeves connected to the pile. The buoyant force, in combination with the anchoring, acts to keep the pile stabilized.

A plurality of piles may be driven at a desired site and a platform structure mounted thereon. The platform may be then outfitted for use as an oil drilling or production facility. By providing rigid bending members, such as trusses or girders, between the pile tops it is possible to further stabilize the structure and to minimize overall rotational displacement of the platform when it is being acted upon by severe environmental conditions. Further enhancements to the basic structure are set forth in the following detailed description.

It will be seen that a platform constructed in accordance with the foregoing is simple in design, inexpensive, easy to construct and well-suited to deep water, offshore applications.

The above features and advantages of the present invention, together with the superior aspects thereof, will be appreciated by those skilled in the art upon reading of the following detailed description in conjunction with the drawings.

DETAILED DESCRIPTION OF THE PREFERRED EMBODIMENTS

Figure 1:
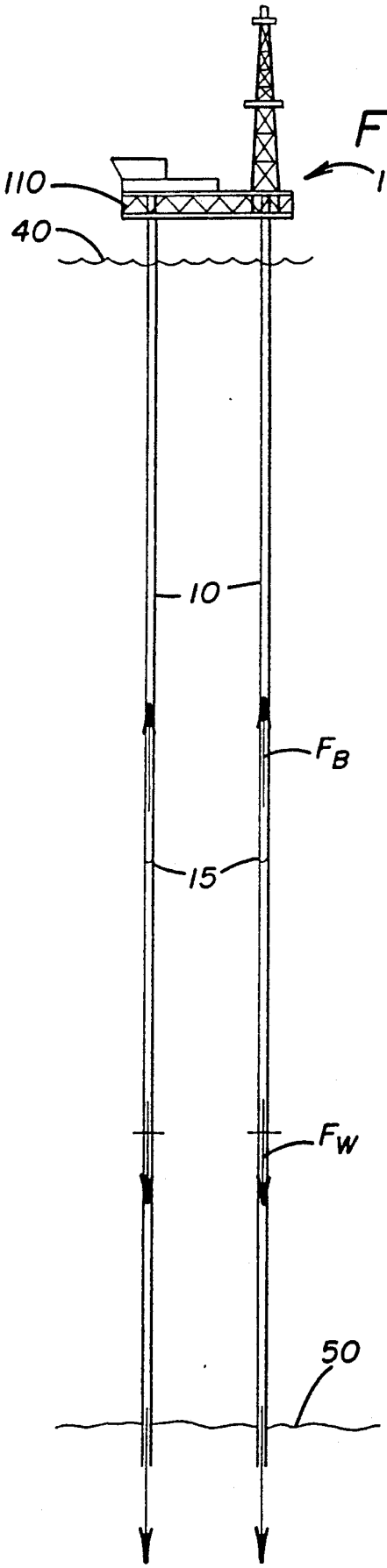
FIG. 1 is an elevation of a deep water oil platform in accordance with the present invention.

In the following detailed description, like parts are marked throughout the specification and drawings with the same reference numerals. The figures are not necessarily drawn to scale, and certain features of the invention and distances may be shown exaggerated in scale in the interest of clarity. Certain features not necessary to an understanding of the invention but which are normally included in offshore oil platforms have been omitted. The omitted features are considered conventional and are well-known to those skilled in the art.

Figure 2:
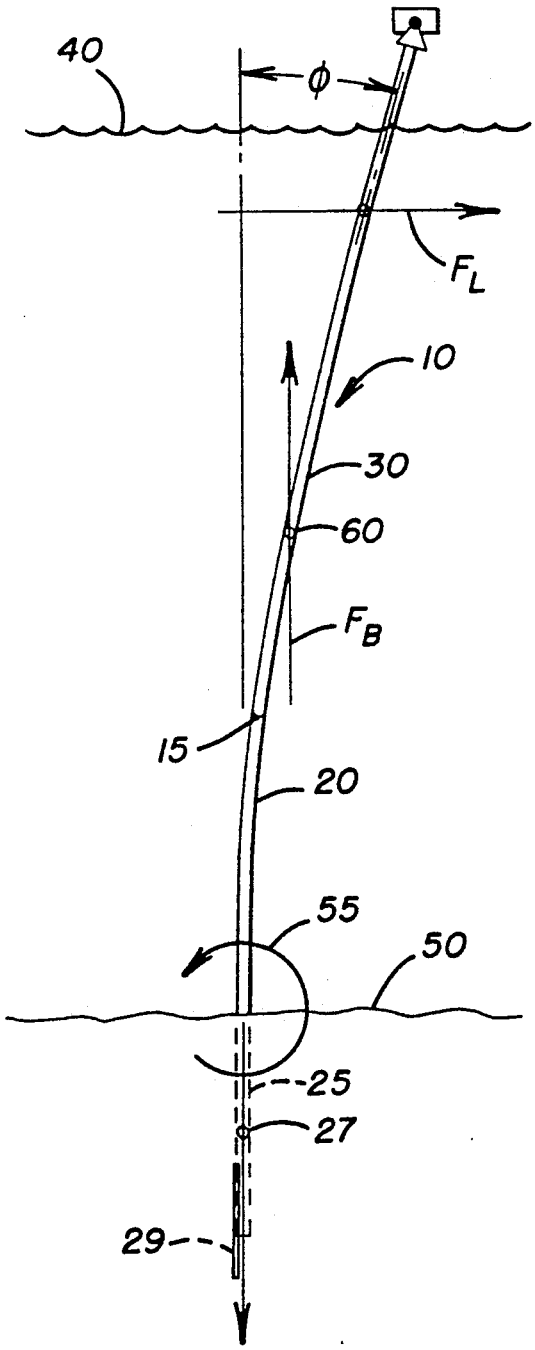
FIG. 2 is an elevation of a flexible pile, constructed in accordance with the present invention, being displaced due to a lateral force thereon.

A pile 10, constructed in accordance with the present invention, is shown in FIG. 2. Pile 10 is constructed of a plurality of hollow pipe segments which may, preferably, be made of high strength steel. In the preferred embodiment the diameter of the pipe is between 1/50th to 1/20th of the water depth at the site. The manner of constructing the pile is described in detail below. A watertight bulkhead 15 is located within pile 10 and separates a lower portion 20 of pile 10 from an upper portion 30. Lower portion 20 is filled with seawater and may be in communication with the water outside the pile, while upper portion 30 is left empty and is in communication with the atmosphere. The substantial empty volume above bulkhead 15 can also be used for product storage, for example, to temporarily store crude oil pumped from beneath the seabed until it can be off loaded onto a tanker. The lower portion 20 of the pile 10 can also be used for product storage so long as precautions are taken to prevent release of product to the environment.

Given the arrangement described, a large volume of seawater is displaced and thereby causes pile 10 to be buoyant. By adjusting the placement of bulkhead 15, the overall buoyancy of pile 10 may be predetermined. Pile 10 is rigidly anchored to the seabed 50, preferably by being driven into seabed 50 using pile driving means. Therefore, a portion 25 of pile 10 is below the seabed. The topmost portion of pile 10 protrudes above sea level 40.

In FIG. 2 a net lateral force $F_L$ due to wind, waves, currents and the like is shown acting on pile 10. As noted above, the pile is relatively flexible due to its great length, and, therefore, the top of pile 10 is displaced laterally by force $F_L$. This lateral movement is resisted by bending of pile 10, which is vertically fixed at the seabed 50, creating bending moment 55 and by buoyant force $F_B$ acting at the center of buoyancy 60. The greater the lateral movement of pile 10, sometimes called the horizontal excursion of the pile, the greater the righting moment is; where the righting moment is proportional to the bending moments 55 and 95 plus the buoyant force times the horizontal distance between the base of pile 10 and the center of buoyancy 60. Stated equivalently, this distance is the horizontal displacement of the center of buoyancy 60 from its location when pile 10 is in a full upright position.

Figure 9:
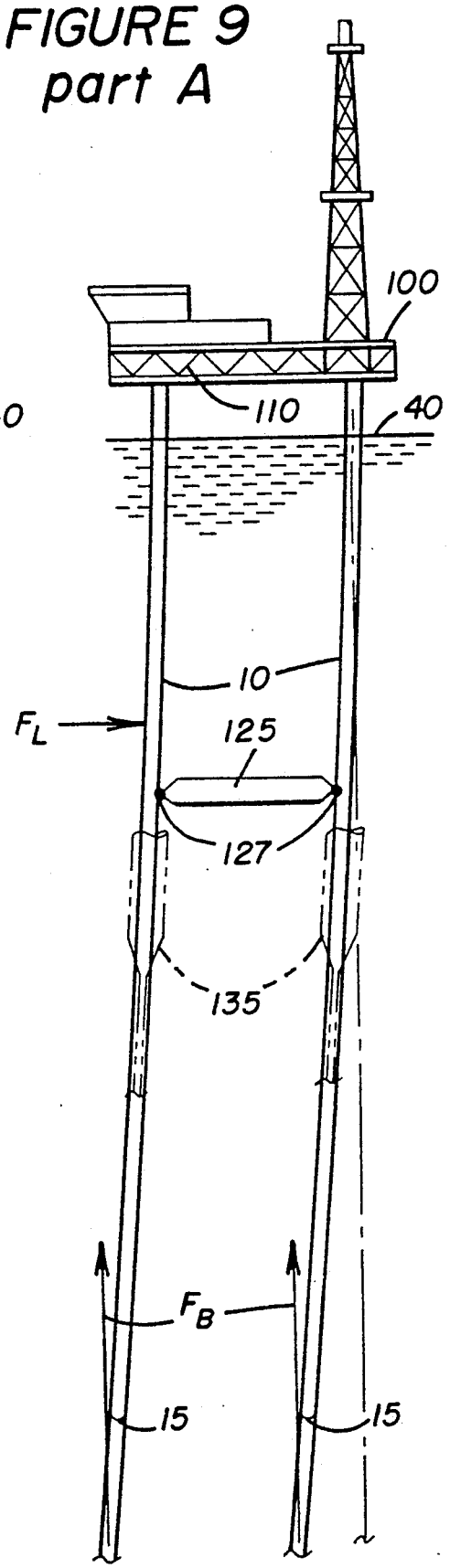
FIGS. 9A and 9B are an elevation of an oil platform, constructed in accordance with another embodiment of the present invention, being displaced due to a lateral force thereon.
Figure 8:
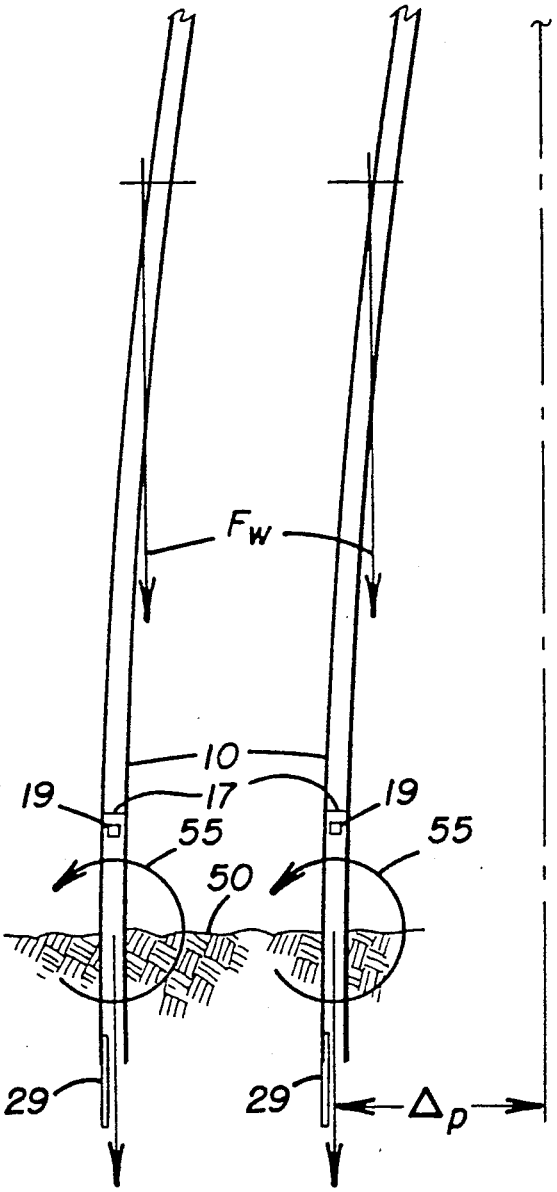
Figure 9:
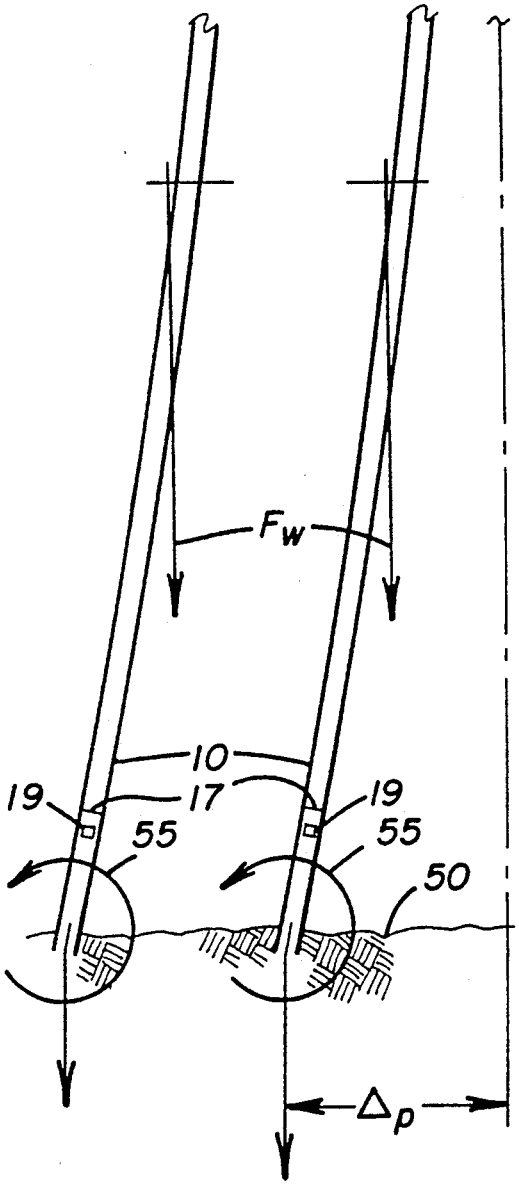

It should also be recognized that, due to the conditions at many sites the seabed will not be entirely rigid but will yield in response to the very high localized forces in the vicinity of the pile bottom. This is shown in FIG. 9, wherein the pile bottom is at seabed 50 is no longer fully vertical, due to a large lateral force $F_L$. A certain amount of flexibility in the seabed is beneficial insofar as it relieves and distributes the force, which would otherwise be very large, at that location. Nonetheless, it is apparent that a seabed which is too yielding will not provide very good anchorage. If pile 10 is driven deep enough into the seabed, there will be a point of fixity 27 (shown in FIG. 2) below which the portion 25 of pile 10 will remain vertical under all expected values of $F_L$.

Likewise, there may be very hard rock at or just below the seabed making it impossible to obtain adequate anchorage by driving the pile 10. In such a situation, other means of anchoring the pile, such as attachment to the rock, will be required. An alternate anchoring technique may not provide the same overall rigidly at the bottom of the pile, thereby reducing the bending moment at the bottom and increasing the lateral excursion when pile 10 is subject to lateral forces.

For some deep water applications a buoyant pile may be all that is needed. For example, for use in connection with a navigational buoy or a small working platform with a universal joint support (as shown symbolically in FIG. 2). However, for many applications the angle of tilt $\phi$, between the upright orientation of pile 10 and the orientation when displaced, might be excessive.

Figure 3:
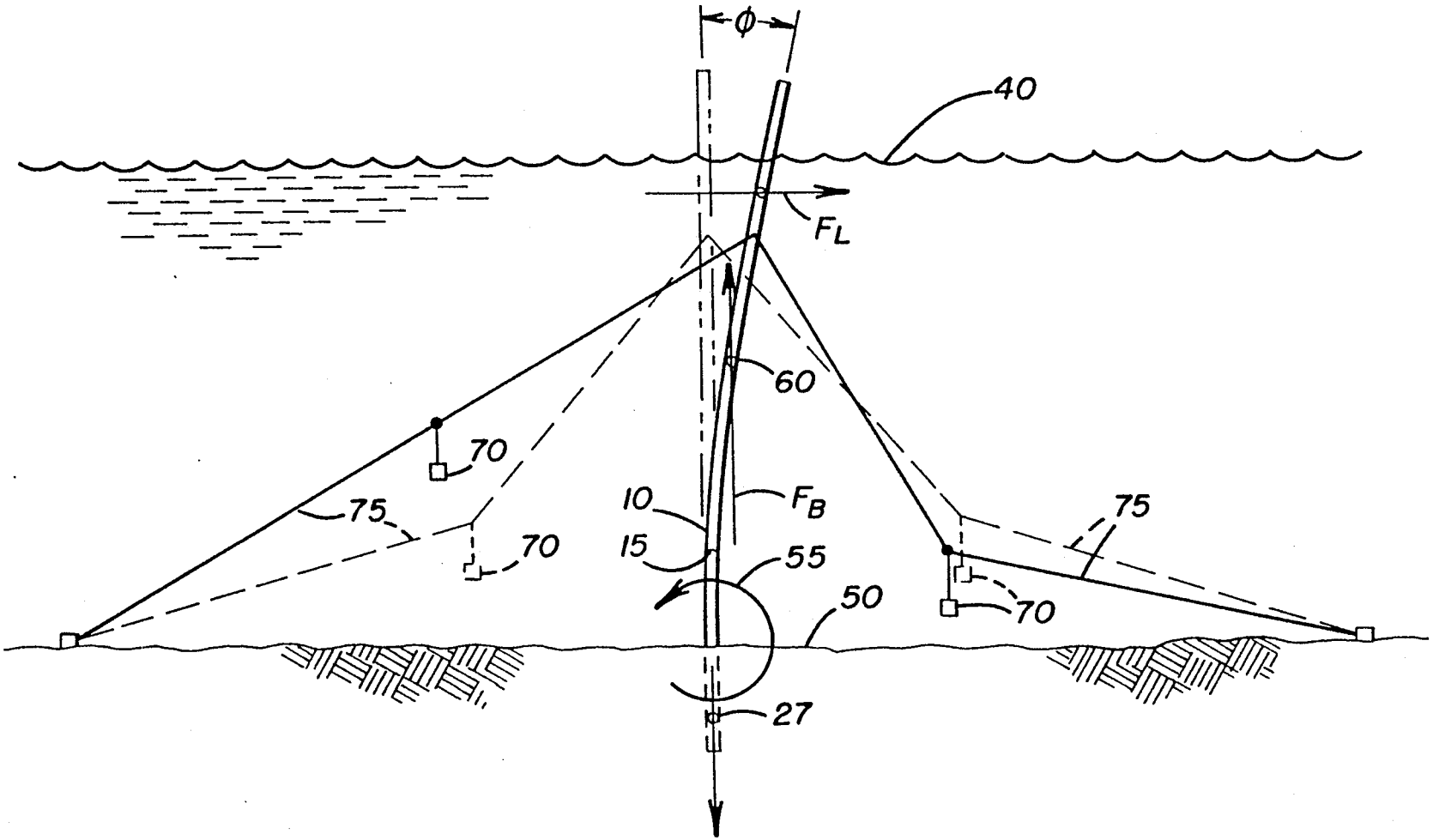
FIG. 3 is a first embodiment of an apparatus to further stabilize the pile of FIG. 2.
Figure 4:
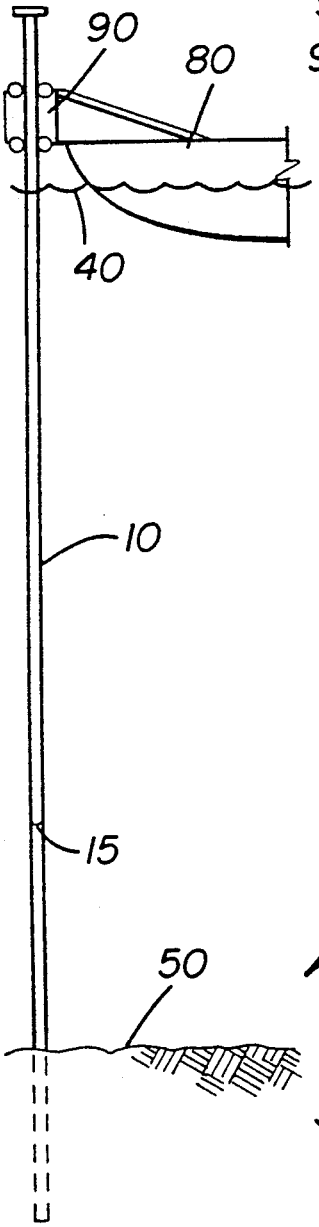
FIG. 4 is a second embodiment of an apparatus to further stabilize the pile of FIG. 3.

Various means can be added to pile 10 to further resist any excursion from a vertical orientation. One such means is shown in FIG. 3, wherein a plurality of weights (preferably three) are connected to pile 10 by means of chains or cables 75, such that any lateral force $F_L$ must also act to cause a net lifting of weights 70. However, even in such a system the top of pile 10 might, at times, be rotated beyond an acceptable departure from the horizontal. Moreover, in very deep water such an anchoring structure would be very long and would add complexity and cost.

Figure 5:
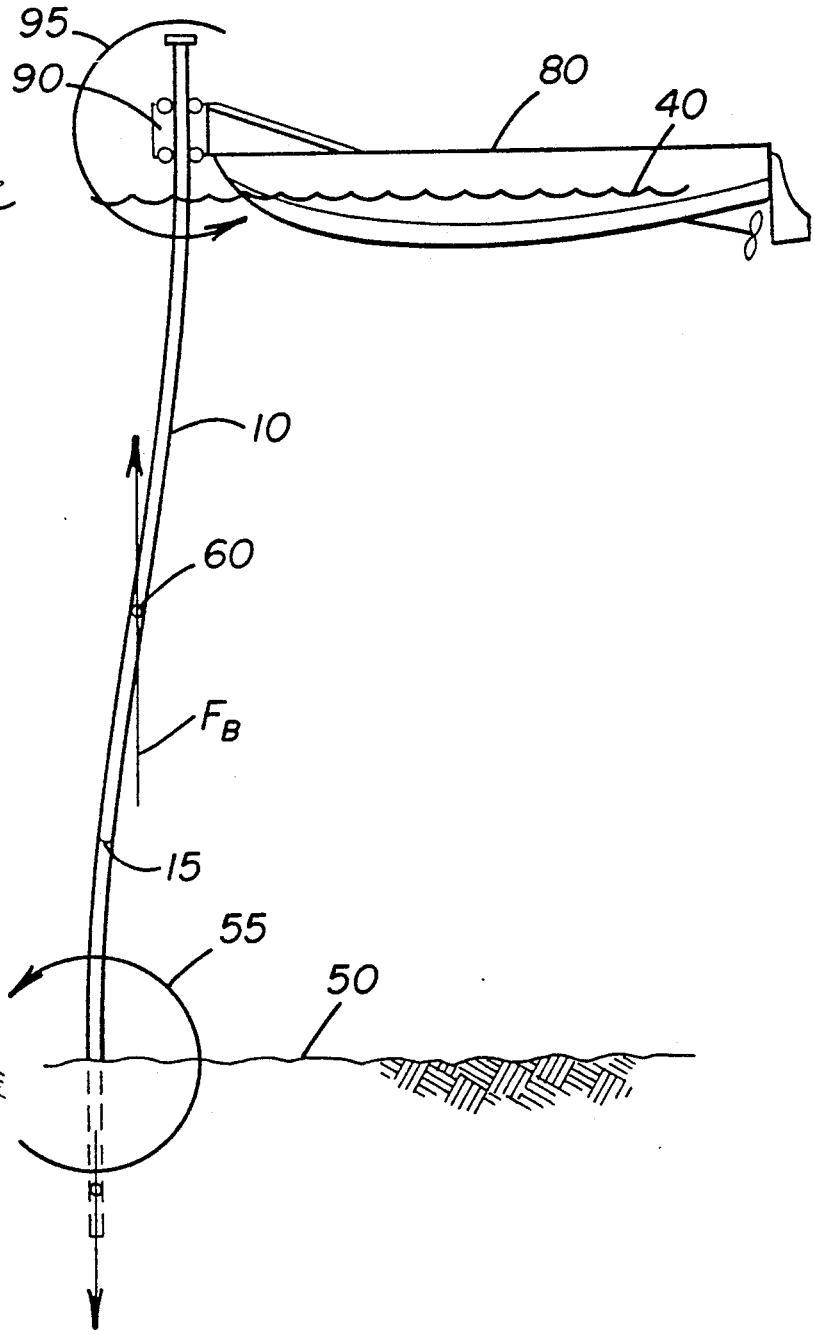
FIG. 5 is the embodiment of FIG. 4 shown being displaced due to a lateral force thereon.
Figure 7:
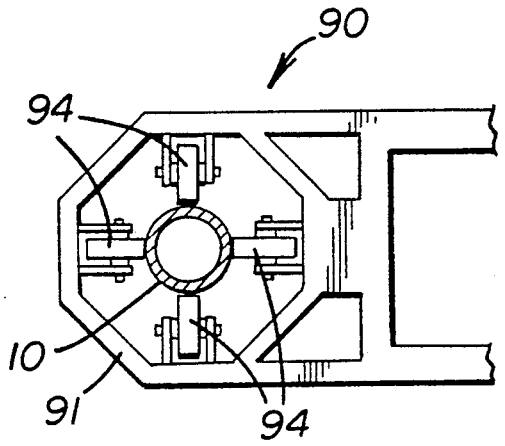
FIG. 7 is a plan view in partial cross section of the detail view of FIG. 6 taken along view line 7—7.
Figure 6:
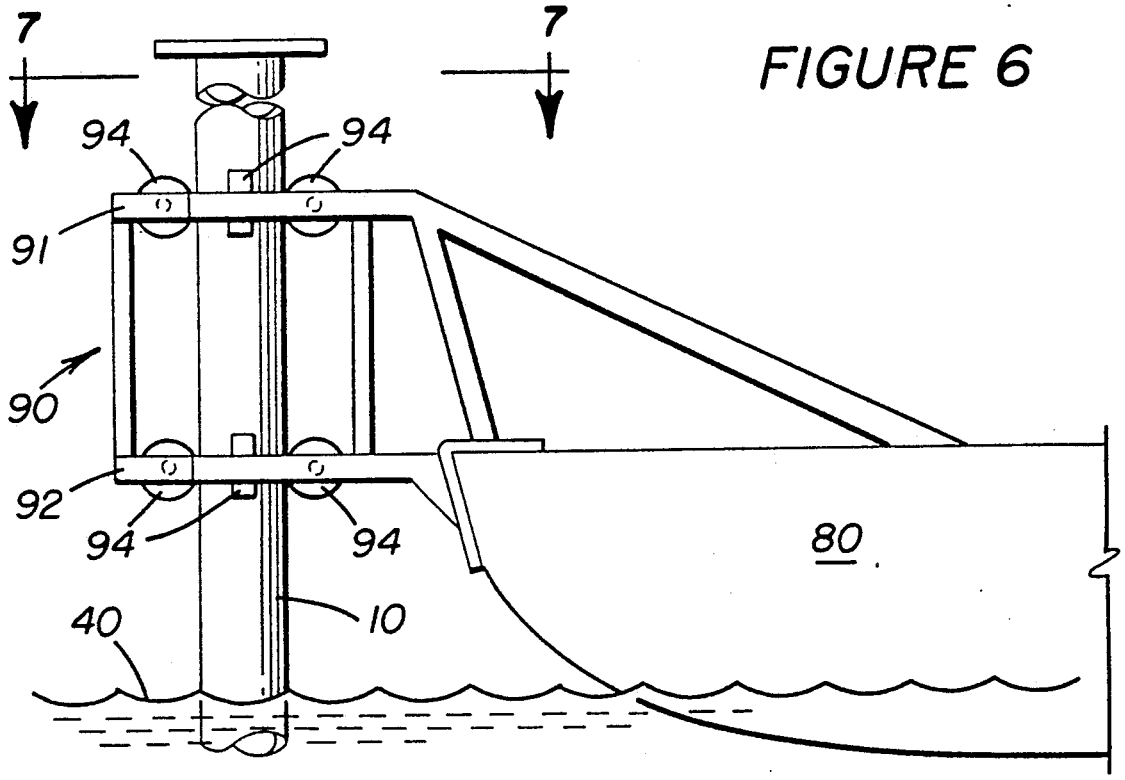
FIG. 6 is a detail view of a portion of the embodiment of FIG. 5.

Another means to resist lateral excursions and to keep the top of pile 10 level is shown in FIGS. 4–7. In this embodiment a large floating structure, i.e., barge 80, with a sliding connection 90 surrounding the top of pile 10 prevents rotation of the top of the pile. Sliding connection 90 is free to move up and down along pile 10 in response to tides and wave action, and as the vertical length of pile 10 decreases in response to lateral forces. FIGS. 6 and 7 show sliding connection 90 in greater detail. Upper and lower collars 91 and 92, respectively, contain a plurality of rollers 94 which are in contact with all sides of pile 10. While two collars are shown it is readily apparent that additional collars may be provided. The combination of sliding connection 90 and barge 80 is free to swivel about pile 10 in a weather vane fashion.

As noted above, a net lateral force $F_L$ applied to flexible pile 10 will cause it to move laterally which, in turn, tends to cause the top of pile 10 to rotate away from a vertical orientation. However, the combination of barge 80 and sliding collar 90 resists any departure of the top of pile 10 from the vertical, as is best shown in FIG. 5. Since both the top and bottom of pile 10 are relatively fixed in the vertical, pile 10 adopts a double curved shape, as shown, when subjected to lateral force $F_L$.

For example, as $F_L$ increases to the right, the top of pile 10 follows a generally arcuate path which moves it downward through sliding collar 90, and which, in the absence of the sliding collar, would tend to displace it from the vertical. However, in response to movement caused by rightward directed force $F_L$, top collar 91 will push to the left and the bottom collar 92 pulls to the right. The couple formed by the two collars creates a bending moment 95 which causes the topmost portion of pile 10 to remain vertical, subject to the pitch of the barge caused by wave action. Further stability can be attained under severe conditions by incorporating a powerful propulsion system in barge 80 to further counteract any lateral forces.

A very long barge 80 will not pitch very much unless subjected to waves that are similarly long. However, many deep water sites are located in open ocean areas where the wavelength may, at times, be quite substantial. Another problem with a barge is that it presents a large surface area to wind, waves and current, all of which may be severe at open ocean sites. This problem could be overcome by using a semi-submersible barge. Again, however, this would add cost and complexity.

A preferred embodiment of the present invention, comprising a platform 100 and a plurality of buoyant piles 10, is shown in FIG. 1. Situated on the platform are the facilities necessary to perform the functions desired to be performed at the site. Such an embodiment is useful at deep water sites where the seabed 50 may be as much as 10,000 ft below sea level. For clarity, only two piles are shown in FIG. 1; however, in the preferred embodiment three or four piles are used.

Figure 8:
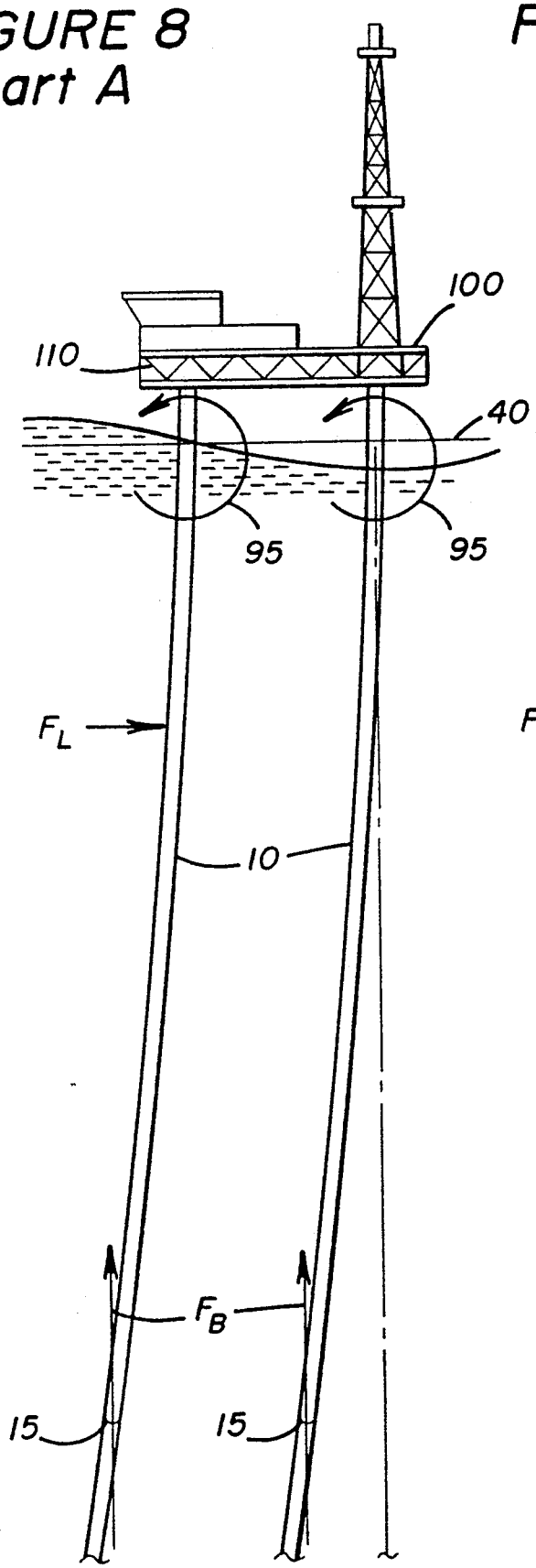
FIGS. 8A and 8B are an elevation of an oil platform, constructed in accordance with an embodiment of the present invention, being displaced due to a lateral force thereon.

The tops of piles 10 are interconnected by a network of rigid bending members such as very stiff and strong girders or trusses 110. The stiffness of network 110 should be sufficient to prevent noticeable rotation of the platform and the pile tops as the piles flex in response to lateral forces, i.e., a minimal departure of the platform surface from the horizontal under such conditions. This result is achieved where the rigid network 110 is attached to each pile 10 at multiple points along its topmost portion. Consider, for example, two points near the top of each of two parallel piles, such that the resulting four points form a rectangle when the piles are vertical. When a lateral force is applied to the piles, the shape formed by these four points will be distorted into a parallelogram in the absence of any interconnection between the points. If, however, the points are rigidly interconnected to maintain a rectangular shape, the top of the rectangle will remain horizontal at all times. As a consequence, when a lateral force $F_L$ is applied to the piles they adopt a double curved shape as shown in FIG. 8. It follows that in order to maintain its rectangular shape when a lateral force is applied, the rigid network will generate a righting moment which resists lateral displacement of the piles. In other words, the overall flexibility and lateral excursion of the system will decrease.

An example of a buoyant pile platform will now be described. A open ocean site is selected where there is stiff clay for several hundred feet below seabed 50. The seabed is 2000 feet below sea level. The platform 100 is to be positioned 100 ft above sea level 40 to provide ample room for the largest expected waves and to accommodate the downward movement of the piles as they are flexed in response to the largest expected lateral forces. It should be understood that the greatest lateral force will arise when the maximum wind and waves forces are in the same direction as the current at the site.

Twenty-three segments of prefabricated pipe 100 ft long and 20 ft in diameter, with a nominal wall thickness of $1\frac{3}{8}''$, are joined at the site in a manner described below to form three piles 2300 ft in length. These piles are then driven 200 ft into the seabed using pile driving means. A permanent, watertight bulkhead 15 is located 1000 ft above the seabed, i.e., 1000 ft below sea level. Each pipe segment weighs 200 tons with its internal conduits, diaphragms, bulkheads, sleeves, etc., and displaces 1005 tons of seawater when the interior volume of the pipe segment is empty. When the interior volume of the pipe is filled with seawater the pipe displaces 26 tons of seawater. Therefore, the net weight of an immersed open ended segment is 174 tons, and the net buoyancy of an air filled pipe segment is 805 tons.

Needless to say, a thorough stress analysis must be conducted prior to developing the specific design for any given site. The methods of performing such analyses are generally known to those skilled in the art. It is necessary to take into account the wind, wave and current forces present at the site under most extreme environmental conditions likely to be encountered.

Winds and waves are essentially surface phenomena. Likewise, currents tend to be greatest near the surface of the water and reduce to negligible amounts within several hundred feet. Thus, the net lateral force $F_L$ will act on pile 10 at a point near sea level 40, as shown in FIGS. 2, 8 and 9.

Two other significant forces on the pile in deep water are the hydrostatic pressure, which is a function of depth, and the buoyant force $F_B$ (which equals the weight of the displaced water) acting at the center of buoyancy 60, i.e., the center of gravity of the displaced water. At 1000 ft below sea level the hydrostatic pressure equals 64,000 pounds per square foot for salt water. While in the preferred embodiment this will not affect the water-filled lower portion 20 of pile 10 below bulkhead 15 which is in communication with the surrounding water and therefore subject to equal pressure in all directions, it causes an enormous force on the empty pile above bulkhead 15, i.e., upper portion 30, placing it in radial and circumferential compression. It should be noted that the cylindrical shape of the piles of the present invention is well suited to withstand such pressure.

The weight of the pile and the weight of the platform and related facilities exerts a downward compressive force $F_w$ along the length of the pile. The magnitude of this force varies over the length of pile 10 and is a function of the pile position, with the lowermost portion of the pile experiencing the greatest force since the weight of the entire column acts on the lower portion. In the preferred embodiment of the present invention this is offset by the larger overall buoyant force $F_B$ so that the entire length of the pile below bulkhead 15 is in tension. The upper portion 30 of pile 10 above bulkhead 15 is in compression as described above.

A sample stress calculation will now be given. The following assumptions, some of which differ from the above example and some of which are for the purpose of simplifying the discussion, have been made: (1) A platform is mounted on three 20 ft diameter, 1" thick piles; (2) the distance between sea level and the seabed is 2000 ft beneath each of the piles, so that the weight of the portion of each pile between sea level and the seabed, including all internal structures such as conduits, diaphragms, etc. is 8000 kips, i.e., 4 kips/ft; (3) the platform deck is 100 ft above sea level; (4) the rigid network extends from the platform deck 30 ft down, creating an upper point of fixity 70 ft above sea level; (5) due to the seabed soil conditions the lower point of fixity is 70 ft below the seabed; (6) the permanent watertight bulkhead is 1200 ft below sea level; (7) the weight of the platform, including the rigid network, all the facilities mounted on the platform, and the portion of the pile above sea level is 21,000 kips, and this weight is evenly distributed among the three piles, i.e., the weight on each pile is 7,000 kips; (8) the worst case environmental conditions are 60 ft waves, 125 mph winds, and a 2.5 mph current at sea level, diminishing to 0 mph at 600 ft below sea level, and that all these forces are equal on all three piles and act in the same direction, resulting in a net lateral force of 450 kips per pile. (One kip = 1,000 lbs = ½ ton.)

From the above there will be a buoyant force of approximately 24,000 kips acting on a center of buoyancy 60 (i.e., the center of gravity of the displaced water), approximately 1400 ft above seabed 50. Since piles 10 are fixed in the vertical about a lower and upper point of fixity, equal upper and lower bending moments are generated in response to the lateral force. These bending moments have been calculated to be approximately 146,000 kips-ft.

The above forces will be applied to a typical pile in the following manner. The primary forces acting to cause an overturning moment about the lower point of fixity are the lateral, i.e., environmental forces, which are applied to the pile relatively close to sea level. The net lateral force will cause the tops of the piles to move horizontally, thereby causing a horizontal excursion of center of buoyancy, the center of gravity of the pile and the center of gravity of the platform. The overturning moment will equal the sum of the separate moments caused by the net lateral force, and by the displaced weights. The moments created by each weight will equal the magnitude of the weight times the distance of the horizontal excursion of the weight measured from the point of fixity. It is self evident that the horizontal excursion of the center of gravity will be smaller than the total horizontal excursion $\Delta_p$ of the platform. It is also apparent that the greater the horizontal excursion caused by the net lateral force, the greater the overturning moment caused by the shifting of the weight, i.e., the more the pile moves, the greater the overturning moment.

Resisting the overturning moment is the righting moment. The righting moment, likewise, has three components. The first component is caused by the buoyant force acting at the center of buoyancy. Again, this moment is proportional to the horizontal displacement of the center of buoyancy. It will be noted that since the center of buoyancy will be above the center of gravity of the pile, the moment arm (i.e., the horizontal displacement) associated with it will be greater. The other components of the righting moment are the bending moments at the top and bottom of the pile. So long as the piles are able to generate a righting moment which equals the largest expected overturning moment they will achieve equilibrium for any value of lateral force. In the foregoing example, equilibrium was established when these moments were calculated to be approximately 1,900,000 kips-ft.

Other calculations show: (1) the lateral excursion of the platform will be less than 90 ft (shown as $\Delta_p$ in FIGS. 8 and 9), with the center of buoyancy being displaced approximately 68 ft and the platform deck being lowered by just a few feet (lowering of the platform must be taken into account so that sufficient freeboard exists under the high wave conditions likely to be associated with the extreme conditions); (2) the tension at the anchorage will be approximately 8700 kips and the tension stress at the anchorage 7.3 kips/in$^2$; (3) the compression stress at the top of the pile will be approximately 9.3 kips/in$^2$; (4) the compression stress just above the bulkhead will be approximately 14.6 kips/in$^2$; (5) the tension stress just below the bulkhead will be approximately 17.4 kips/in$^2$; (6) the combined bending and compression stresses at the top of the pile will be as high as approximately 48 kips/in$^2$; and, (7) the combined bending and tension stress at the bottom of the pile will be as high as approximately 46 kips/in$^2$. All the foregoing calculated stresses are reasonable for high strength steel.

The foregoing calculations are somewhat complex to perform although well within the ability of one skilled in the art of structural engineering. In view of the many factors involved it is not possible to provide a formula for determining the optimal location of the watertight bulkhead. In the preferred embodiment, bulkhead 15 must be located far enough below sea level to cause the pile to be buoyant, i.e., the weight of the displaced water should exceed the weight of the loaded pile. Important factors that enter into a determination of the optimal location include the number of piles, the weight of the load to be supported, the depth of the water at the site, the maximum environmental stresses that may be encountered at the site, the choice of pile material, including the diameter, thickness, density, moment of inertia and other inherent material properties, the nature of the seabed, etc.

Generally speaking, lowering the bulkhead will cause more water to be displaced thereby increasing the buoyancy of the pile. It follows that the tension in the pile at the seabed will also increase requiring that the anchorage be quite strong. While lowering the bulkhead will lower the center of buoyancy, (having only a small effect on the horizontal location of the center of gravity), the extra buoyancy will generate an increased overall righting moment, increasing the overall stability of the pile, provided that the anchorage is strong. Finally, the lower the bulkhead, the greater the radial and circumferential compressive forces on the pile immediately above the bulkhead, since this point will be a greater distance below sea level.

Overall, increasing the buoyancy of the pile enhances its ability to withstand extreme environmental forces. However, there will be point when increased buoyancy will create too much tension in the pile and cannot be tolerated. There may be circumstances when an anchorage of sufficient strength cannot be provided. Even when a solid anchorage is possible the allowable tension is limited by the tensile strength of the pile material. When a good anchorage cannot be provided, and environmental forces are not too severe, it may be desired to design the pile to have neutral, or even slightly negative buoyancy. Negative buoyancy will, of course, assist is anchoring the pile. Even when there is slightly negative buoyancy, the righting moment generated by the horizontal displacement of the center of buoyancy can exceed the overturning moment generated by the horizontal displacement of the weight due to the fact that the buoyant force is acting on a longer moment arm.

By varying the diameter or the wall thickness of the buoyant pile one can obtain different effects. For example, if the diameter of the upper part of pile 10 is increased, the buoyant force $F_B$ is increased, with the distance from the seabed 50 to the center of buoyancy 60 is increased, and the horizontal distance between the anchorage and the center of buoyancy is increased for a given $F_L$. Thus, the righting moment will increase and the lateral movement of the pile will be decreased for a given $F_L$. The smaller diameter lower portion will have more flexibility resulting in less stress for a given lateral excursion. Such an arrangement is shown symbolically at 35 in FIG. 9.

Likewise, by increasing the wall thickness of the pile in the vicinity of the seabed it is possible to compensate for the locally high cyclical bending stress.

Underwater horizontal struts 125 (one such strut is shown in FIG. 9) can be fixed to the piles. Such struts can add buoyancy by, for example, making them of air-filled sealed pipe. Such added buoyancy may be beneficial if the struts are in the upper portion of the pile. Preferably, such struts should be located below the depth of the wave and current forces so to minimize any added lateral loading. Struts 125 can be joined to piles 10 by pin connections 127. Struts 125 will also assist in maintaining the desired distance between very long piles.

A construction procedure, useful in building the piles of the present invention, is as follows. The pile segments are brought to the site by a barge. In one of the above examples 100 ft segments were described, however, considering the present size and capacity of marine cranes and barges, segments up to 300 ft in length could also be used. Piping, diaphragms, stiffeners and conduits used permanently are preinstalled in each pipe segment. Preselected segmets also contain the permanent watertight bulkhead 15 and a construction bulkhead 17 (shown in FIGS. 8 and 9).

The first pile segment is then placed and held in the water so that it sits vertically in the water with only its topmost portion protruding above the surface. A welding platform and gantry may be located at one end of the barge so as to surround the protruding portion of the pipe segment. The second segment is lifted into registry with the first segment by a marine crane and welded to the top of the first segment. This process is continued with the remaining pile segments, with the construction bulkhead 17 being used to create buoyancy to support the pile under construction as follows.

In most situations one of the first three pile segments will contain the construction bulkhead 17. The pile segment which contains the construction bulkhead will be determined by the length of the pile segments and the depth that the pile is to be driven into the seabed. The pile is designed so that construction bulkhead 17 is positioned above the seabed after the pile is fully driven, as shown in FIGS. 8 and 9, since it would be impractical to drive bulkhead 17 into the seabed. Thus, when using 100 ft pile segments and assuming that the pile is to be driven 200 ft into the seabed, the construction bulkhead should be located in the third pile segment. On the other hand when using 200 ft pile segments, and assuming that the pile is to be driven 150 ft into the seabed, the construction bulkhead should be in the first pile segment.

Once the pile segment containing construction bulkhead 17 is incorporated into the pile the overall buoyancy of the resulting pile portion is adjustable by partially flooding the volume above the construction bulkhead so that the topmost portion of the pile under construction may be made to protrude above the surface of the water by virtue of its own buoyancy. The process of adding additional segments and adjusting the buoyancy is then repeated with the remaining segments until pile 10 reaches the seabed.

Next, the buoyancy of the pile is reduced by filling a portion of the pile volume above the permanent bulkhead with water so that the bottom tip of the pile is driven into the seabed by its own weight. The buoyancy should not be reduced to the point that the lower part of the pile is overloaded in compression. Moreover, a certain amount of buoyancy is necessary to maintain the pile in a vertical orientation, in addition to ensuring that the lower part is not overloaded.

A pile driver then drives pile 10 deep into the seabed 50. If the depth that the pile is to be driven exceeds the length of a pile segment it may be necessary to add one or more additional segments of pipe during the pile driving process. However, this is not preferred due to problems which may arise if pile driving is interrupted.

There must be openings 19 (shown in FIGS. 8 and 9) in the pile above the seabed to allow water to escape during pile driving. Preferably, these openings are several feet below bulkhead 17, and there is an air pocket between the openings and the bulkhead. The openings are necessary because the trapped water would otherwise cause the pile to act as a solid cylinder, making the pile driving operation much more difficult. The air pocket serves as a shock absorber to reduce the impact forces that could otherwise rupture the construction bulkhead. During the pile driving process the buoyancy of the pile is kept as low as possible but must not be too low for the reasons described above. As the pile is driven it may be necessary to add water to the pile to maintain the proper buoyancy.

After the pile is driven to the desired depth, which in the example given is 200 ft, one or more smaller diameter pipes 29, for example, two to three feet in diameter and pre-positioned within the much larger pile, may be driven further into the seabed to provide additional anchorage. The smaller pipes 29 are then rigidly connected to pile 10, for example, by being grouted to an inside sleeve of the pile.

This procedure is then repeated to build the desired number of piles. Continuing the example given above, three piles are built in accordance with the foregoing procedure, each pile being positioned 200 ft from its neighbors, thereby forming an equilateral triangle. Water is then pumped out of the piles above the permanent bulkhead, thereby putting the piles in tension below the bulkhead. The piles are all simultaneously pumped at an equal rate to ensure equal loading.

The network of large girders or trusses is then installed using conventional marine construction techniques. In our example, these are 220 ft long and 30 ft deep. Thereafter, the platform deck and facilities such as production modules, drilling modules, drilling rigs, quarters and helideck are added in a conventional manner.

The addition of submerged struts, if desired, is done after the piles have been driven, since it is not contemplated that all the piles are driven simultaneously. Therefore, this addition involves underwater construction techniques.

Those skilled in the art will recognize that numerous other modifications and departures may be made with the above-described apparatus without departing from the scope and spirit thereof. It is therefore intended that the scope of the present invention be limited only by the following claims.

What is claimed is:

1. A deep water support system for supporting a structure adjacent to the surface of a body of water at a preselected site, comprising;

at least one buoyant pile having a lower end anchored to the bottom of said body of water, said pile being of a length greater than the depth of said body of water at said site, means at the upper end of said pile for securing said structure and for resisting any departure from the vertical of the portion of said upper end of said pile above the surface of said body of water, said pile comprising an elongate tubular structure having an interior watertight bulkhead means positioned at a predetermined location within said pile interior, the portion of said pile above said bulkhead means being filled with air and the portion of said pile below said bulkhead means being filled with water, the location of said bulkhead means being selected so that said pile has a predetermined buoyancy, said predetermined buoyancy being such that the portion of said pile below said bulkhead is in substantial tension.

2. The deep water support system of claim 1 wherein the number of piles is greater than one.

3. The deep water support system of claim 2 further comprising means for rigidly interconnecting said piles above the surface of said body of water.

4. The deep water support system of claim 3 wherein said interconnecting means comprises an assemblage of rigid bending members forming a rigid framework.

5. The deep water support system of claim 2 further comprising strut means for interconnecting said piles below said surface.

6. The deep water support system of claim 5 wherein said strut means is buoyant.

7. The deep water support system of claim 5 wherein said strut means is located at sufficient depth such that it is not directly acted on by significant lateral forces due to environmental factors.

8. The deep water support system of claim 1 wherein said pile is anchored to said bottom by being embedded in said bottom.

9. The deep water support system of claim 8 wherein said pile is embedded in said bottom by means of pile driving.

10. The deep water support system of claim 8 wherein said pile is further anchored to said bottom by means of at least one additional tubular member of smaller diameter than said pile, said additional tubular member extending further into said bottom than said pile and being attached to said pile.

11. The deep water support system of claim 1 wherein the diameter of said pile is different near said bottom than it is near said surface.

12. The deep water support system of claim 1 wherein the thickness of the wall of said pile is different near said bottom than it is near said surface.

13. A deep water support system for supporting a structure above the surface of a body of water at a preselected site, comprising;

at least one pile having a lower end anchored to the bottom of said body of water, said pile being of a length greater than the depth of said body of water at said site, means at the upper end of said pile for resisting any departure from the vertical of the portion of said upper end of said pile above the surface of said body of water, said at least one pile comprising an elongate tubular structure having an interior watertight bulkhead means positioned at a predetermined location within said pile interior, the portion of said pile above said bulkhead means being in fluid communication with the atmosphere and the portion of said pile below said bulkhead means being in fluid communication with the surrounding water, said location selected so that said pile has a predetermined buoyancy.

14. The deep water support system of claim 13 further comprising a watertight construction bulkhead means for adjusting the buoyancy of said pile while it is being constructed and not yet anchored.

15. The deep water support system of claim 14 further comprising at least one opening in the wall of said pile located below said construction bulkhead providing communication between the interior volume of the pile below said construction bulkhead and the surrounding water.

16. The deep water support system of claim 15 further comprising an air pocket located between said construction bulkhead and said at least one opening.

17. A deep water support system for supporting a structure above the surface of a body of water at a preselected site, comprising;

a plurality of generally hollow piles having their lower ends anchored to the bottom of said body of water, each of said piles being of a length greater than the depth of said body of water at position it is anchored at, a network of rigid bending members attached at the upper end of said piles and interconnecting said piles for resisting any departure from the vertical of the top of said piles, each said pile comprising an elongate tubular structure having an interior watertight bulkhead means positioned at a predetermined location within said pile interior, the interior volume of said piles above said bulkhead means being filled with gas and the interior volume of said piles below said bulkhead means being filled with liquid, said location selected so that said pile has a predetermined buoyancy, said predetermined buoyancy acting at a center of buoyancy of each pile which is above the combined center of gravity of the weight supported by the pile.

18. A method of constructing a deep water buoyant pile at a selected site comprising the steps of;

prefabricating a plurality of pile segments, a selected one of said pile segments having a watertight bulkhead, transporting said pile segments to said site, placing a first pile segment in the water, and holding said first pile segment vertically in the water with an upper end protruding above the surface of the water, attaching the second pile segment to the first pile segment and holding the resulting pile portion vertically in the water with its upper end protruding above the surface of the water, repeating the foregoing step until said pile portion reaches the bottom of the water body, after said pile segment containing said watertight bulkhead is attached, partially filling said pile portion so that it has a predetermined buoyancy, said predetermined buoyancy being such that said pile portion assumes a vertical orientation with an upper portion which protrudes a desired distance above the surface of the water, and thereafter, readjusting the buoyancy after each subsequent pile segment is attached, rigidly anchoring the resulting pile to said bottom.

19. The method of claim 18 wherein said step of anchoring comprises embedding said pile into said bottom.

20. The method of claim 19 wherein said pile is driven into said bottom by pile driving means.

21. The method of claim 19 further comprising the step of embedding at least one pipe segment, having a smaller diameter than said pile, further into said bottom and, thereafter, attaching said pipe segment to said pile.

22. The method of claim 19 further comprising the step of adjusting the buoyancy of the anchored pile so that the bottom of said pile is in tension.

23. The method of claim 22 wherein said buoyancy is adjusted by removing the water above a permanent watertight bulkhead at a predetermined location within the pile.

* * * * *

UNITED STATES PATENT AND TRADEMARK OFFICE

CERTIFICATE OF CORRECTION

PATENT NO. : 5,118,221

DATED : June 2, 1992

INVENTOR(S) : Robert W. Copple

It is certified that error appears in the above-identified patent and that said Letters Patent is hereby corrected as shown below:

Column 3, line 19, delete "1/20th" and insert therefor --1/200th--.

Signed and Sealed this

Fourteenth Day of June, 1994

Bruce Lehman

*Attest:*

BRUCE LEHMAN

*Attesting Officer*

*Commissioner of Patents and Trademarks*